US010308026B2

(12) United States Patent
Coma Vives et al.

(10) Patent No.: US 10,308,026 B2
(45) Date of Patent: Jun. 4, 2019

(54) REPLACEABLE SHIELD FOR A PRINTHEAD

(71) Applicant: HEWLETT-PACKARD DEVELOPMENT COMPANY, L.P., Houston, TX (US)

(72) Inventors: Marta Coma Vives, Barcelona (ES); Xavier Gros Gras, Sant Cugat del Valles (ES); Francesc Melia Sune, Barcelona (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/101,313

(22) PCT Filed: Dec. 13, 2013

(86) PCT No.: PCT/US2013/074878
§ 371 (c)(1),
(2) Date: Jun. 2, 2016

(87) PCT Pub. No.: WO2015/088545
PCT Pub. Date: Jun. 18, 2015

(65) Prior Publication Data

US 2016/0303856 A1 Oct. 20, 2016

(51) Int. Cl.
*B41J 2/14* (2006.01)
*B41J 2/15* (2006.01)
*B41J 2/165* (2006.01)

(52) U.S. Cl.
CPC ..... *B41J 2/16505* (2013.01); *B41J 2/1433* (2013.01); *B41J 2/15* (2013.01); *B41J 2202/19* (2013.01); *B41J 2202/20* (2013.01)

(58) Field of Classification Search
CPC ..... B41J 2/16505; B41J 2/1433; B41J 2/15; B41J 2202/19; B41J 2202/20
See application file for complete search history.

(56) References Cited

U.S. PATENT DOCUMENTS 5,877,788 A 3/1999 Haan et al.
6,189,999 B1 2/2001 Pham et al.
6,190,007 B1 2/2001 Taylor et al.
6,244,683 B1 * 6/2001 Alvarez ..... B41J 2/1752 347/22
6,464,327 B1 10/2002 Eckard et al.
(Continued)

FOREIGN PATENT DOCUMENTS

EP 1033253 9/2000

OTHER PUBLICATIONS

Meinhart, C.D. et al.; The Flow Structure Inside a Microfabricated Inkjet Printhead ; http://ieeexplore.ieee.org/stamp/stamp.jsp?arnumber=825779 > On pp. 67-75; vol. 9; Issue: 1; Mar. 2000.
(Continued)

*Primary Examiner* — Stephen D Meier
*Assistant Examiner* — Alexander D Shenderov
(74) *Attorney, Agent, or Firm* — HP Inc. Patent Department

(57) ABSTRACT

In one example, a structure to hold a printhead includes a surface defining an opening through which the printhead orifices may be exposed for printing and a replaceable shield shielding an area of the surface around the opening.

19 Claims, 8 Drawing Sheets

(56) References Cited

U.S. PATENT DOCUMENTS

| | | | | |
|---|---|---|---|---|
| 6,481,838 | B1 | 11/2002 | Brugue et al. | |
| 6,575,553 | B1 | 6/2003 | Williams et al. | |
| 6,755,513 | B1 | 6/2004 | Silverbrook et al. | |
| 2002/0109746 | A1* | 8/2002 | Murakami | B41J 2/2114 347/29 |
| 2006/0033773 | A1* | 2/2006 | Owaki | B41J 2/1606 347/45 |
| 2010/0002051 | A1* | 1/2010 | Yoshimura | B41J 2/15 347/40 |
| 2012/0038708 | A1 | 2/2012 | Ishii et al. | |

OTHER PUBLICATIONS

Korean Intellectual Property Office, International Search Report and Written Opinion for PCT/US2013/074878 dated Oct. 2, 2014 (13 pages).

* cited by examiner

REPLACEABLE SHIELD FOR A PRINTHEAD

BACKGROUND

Inkjet printers utilize printheads that include many tiny orifices through which ink is dispensed on to paper or other print substrate. It is desirable for many inkjet printhead assemblies to wipe the surface of each printhead surrounding the dispensing orifices periodically to remove ink residue that may interfere with good quality printing.

DRAWINGS

The same part numbers designate the same or similar parts throughout the figures.

DESCRIPTION

One undesirable effect of wiping the printheads in an inkjet printer to remove ink residue is the accumulation of ink residue on exposed surfaces around the printheads. In some conventional large format inkjet printers in which high volumes of ink are dispensed from printheads carried by a scanning carriage, a metal shield is permanently installed over the bottom of the carriage around the printheads to protect the carriage against corrosion from ink residue. After a large quantity of ink residue accumulates on the shield, some of the residue can be dislodged during printhead replacement or even during printing and fall on to the print substrate support platen or on to the print substrate.

It has been discovered that new printhead cross-wiping techniques cause ink residue to accumulate on the bottom of the carriage and along the exposed sides of the printheads so that the carriage can no longer survive to its normal end-of-life service replacement. To help resolve this problem, a new, replaceable shield has been developed to protect the carriage. The new shield is easily removed from the carriage assembly and can be replaced before a potentially damaging quantity of ink residue accumulates on the shield, thus regenerating the surfaces around the printheads to minimize the risk of ink residue reaching the print substrate or the platen throughout the normal useful life of the carriage.

The examples shown in the figures and described herein illustrate but do not limit the invention, which is defined in the Claims following this Description.

As used in this document, a "printhead" means that part of an inkjet printer or other inlet type dispenser that dispenses fluid, for example as drops or streams. A "printhead" is not limited to printing with ink but also includes inkjet type dispensing of other fluid and/or for uses other than printing.

Figure 1:
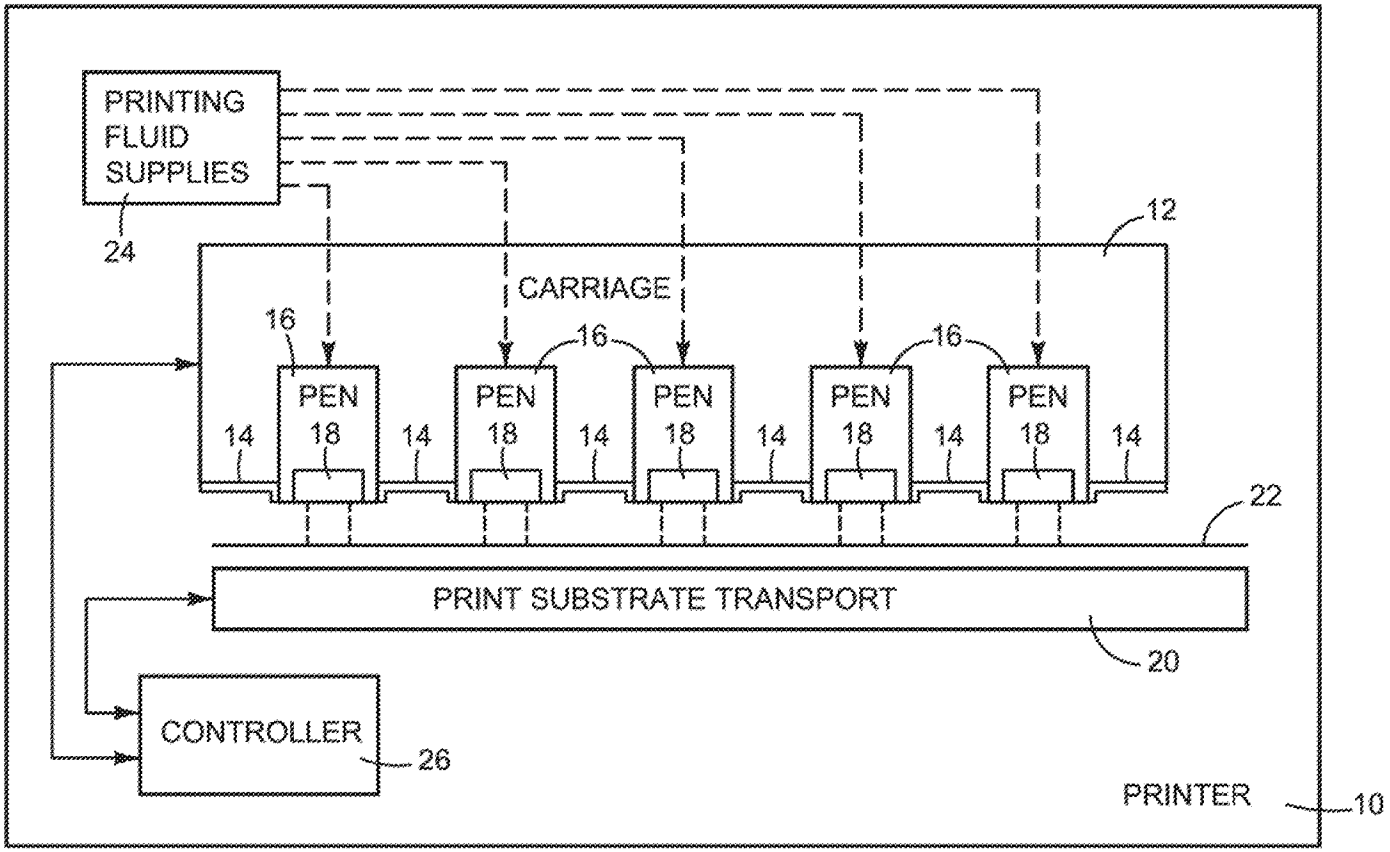
FIG. 1 is a block diagram illustrating an inkjet printer with a printhead carriage implementing one example of a replaceable printing fluid shield.
Figure 2:
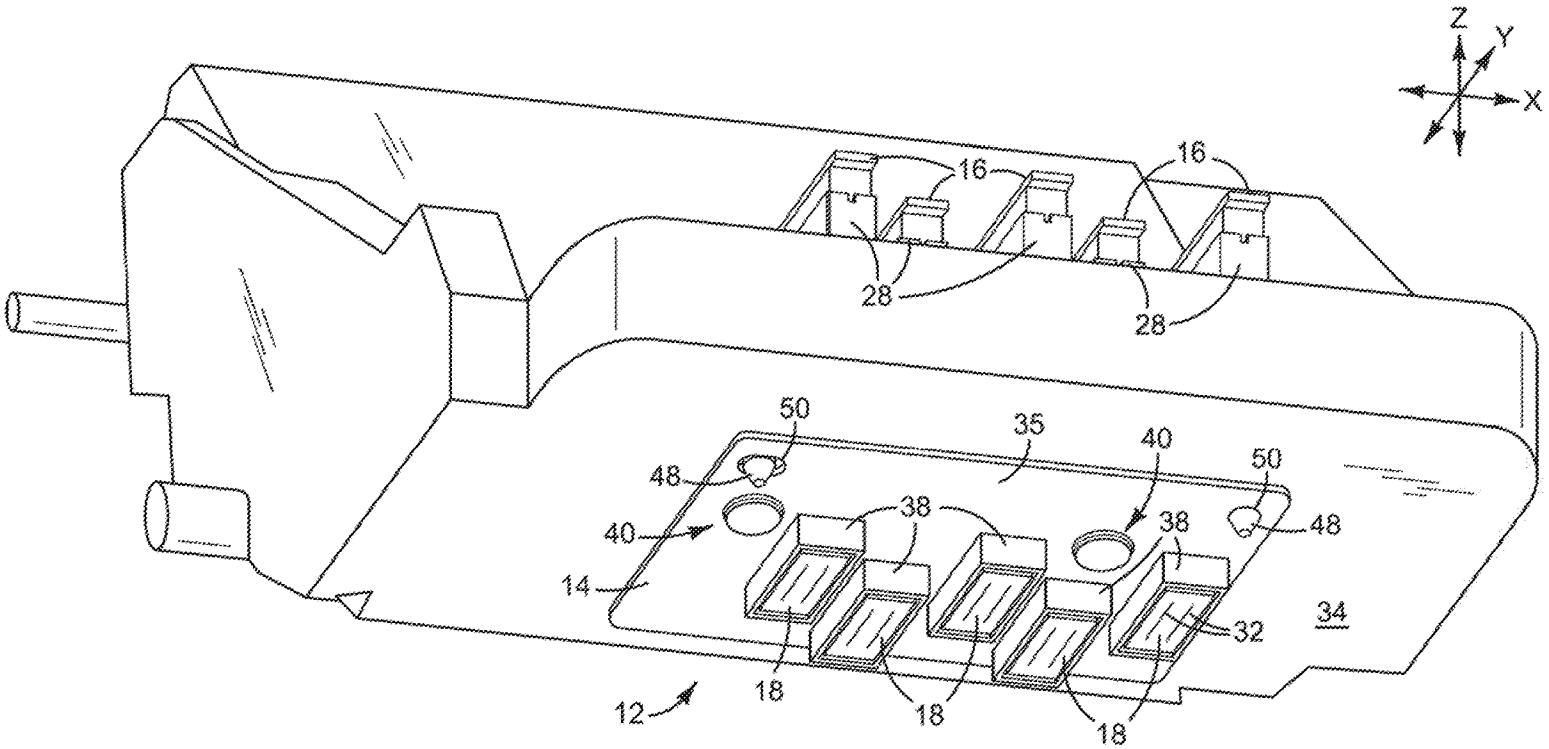
FIGS. 2 and 3 are perspective bottom and top views, respectively, illustrating a printhead carriage implementing one example of a replaceable printing fluid shield such as might be used in the printer shown in FIG. 1.
Figure 3:
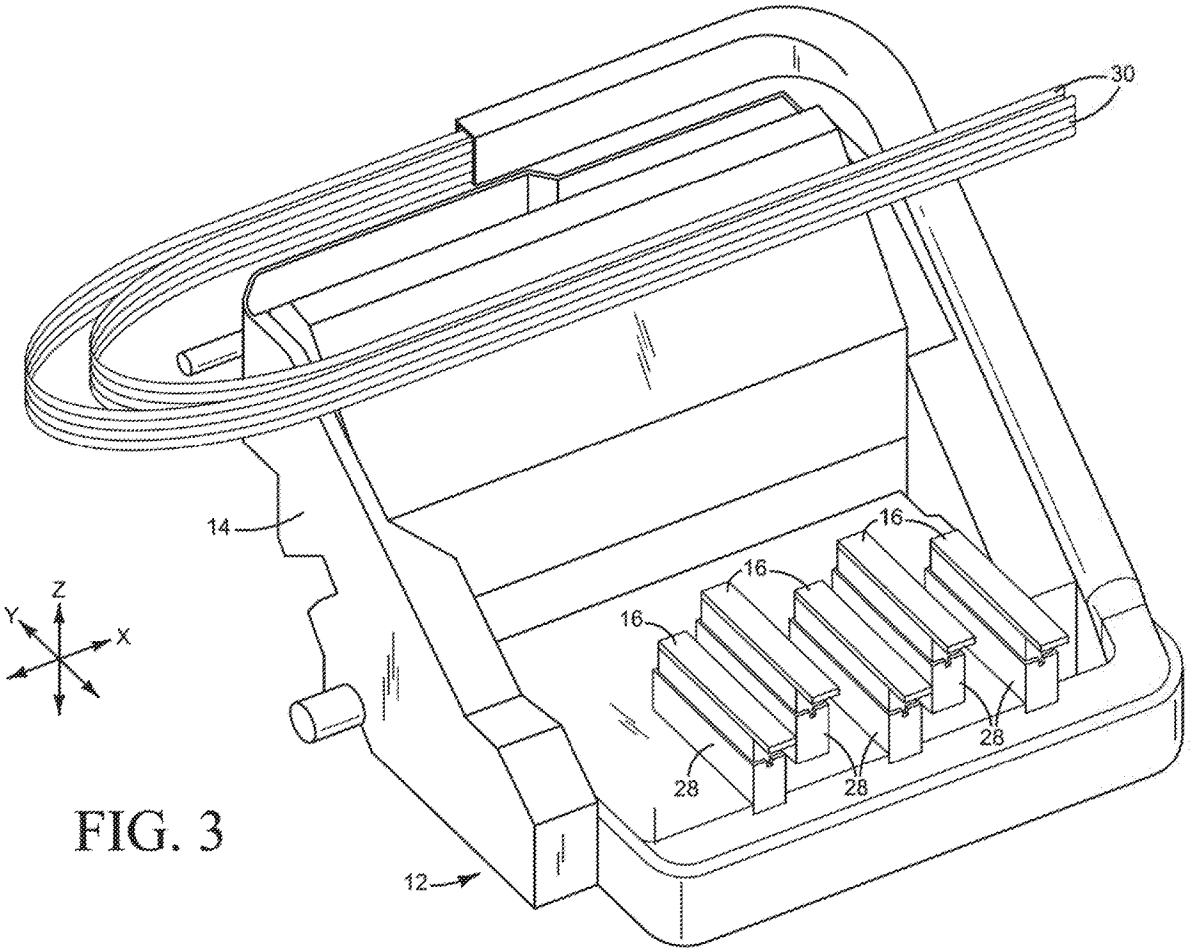
Figure 4:
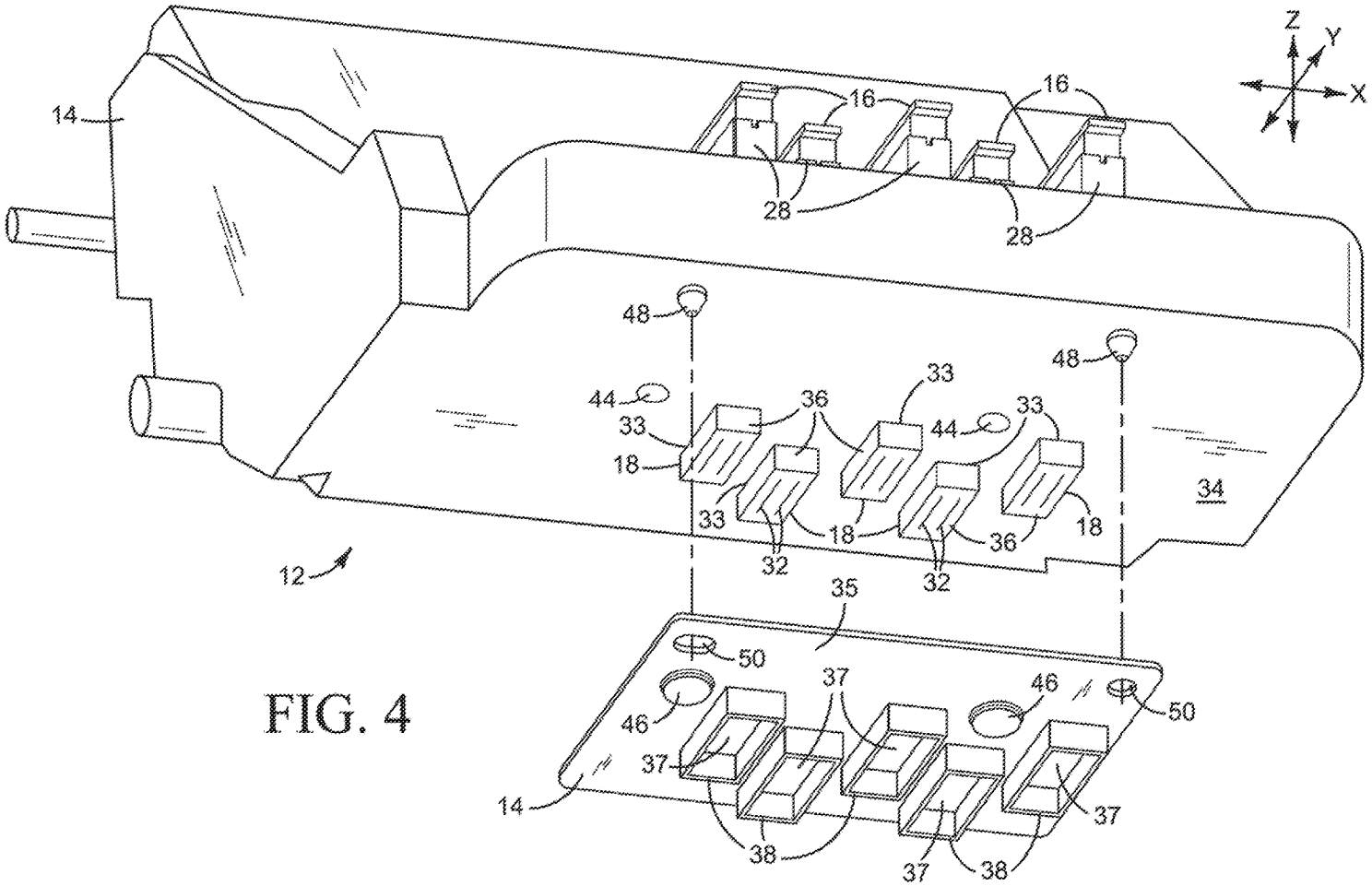
FIG. 4 is the perspective view of FIG. 2 with the printing fluid shield exploded away from the body of the carriage.
Figure 5:
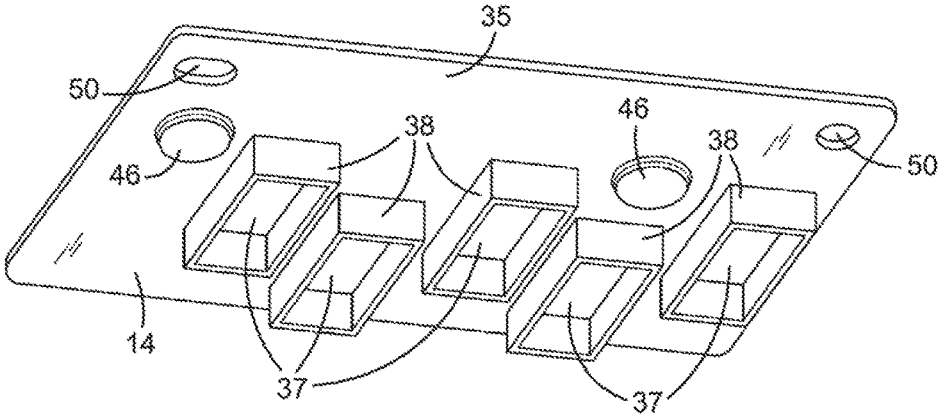
FIGS. 5 and 6 are perspective views of the printing fluid shield in the carriage shown in FIGS. 2-4.
Figure 6:
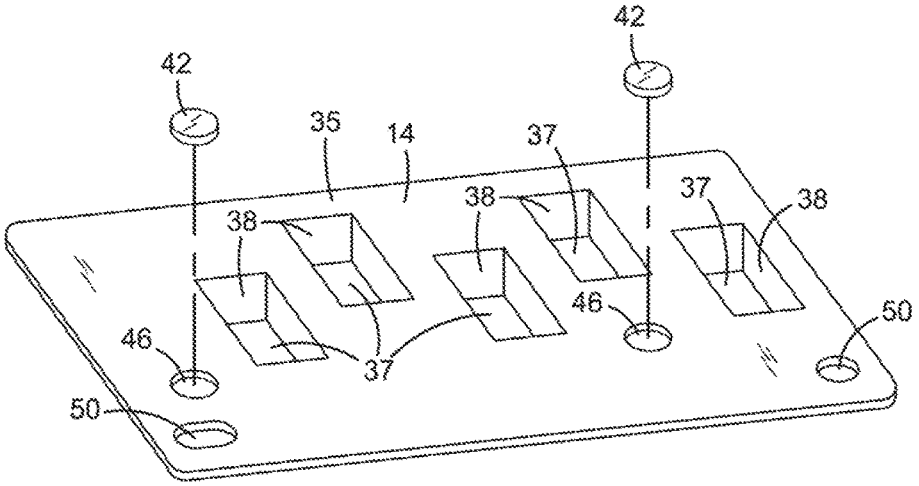

FIG. 1 is a block diagram illustrating an inkjet printer 10 with a printhead carriage 12 implementing one example of a replaceable printing fluid shield 14. FIGS. 2-6 illustrate a printhead carriage 12 implementing one example of a replaceable shield 14 such as might be used in the printer 10 shown in FIG. 1. Referring first to FIG. 1, printer 10 includes a carriage 12 carrying multiple ink pens 16. Inkjet ink pens 16 are also commonly referred to as ink cartridges or print cartridges and may dispense ink and other printing fluids from a printhead or multiple printheads 18 contained within the pen. As described in detail below with reference to FIGS. 2-6, shield 14 covers the exposed bottom surface of carriage 12 in the areas surrounding the dispensing orifices of each pen 16 to collect ink residue that would otherwise accumulate on carriage 12. Carriage 12 with pens 16 illustrates just one example of a printhead assembly implementing a replaceable shield 14. Other types of printhead assemblies implementing a shield 14 are possible. For example, instead of ink pens 16 with integrated printheads 18 shown in FIG. 1, the printhead(s) could be mounted separately on carriage 12 with replaceable ink containers operatively connected to the carriage mounted printhead(s).

A transport mechanism 20 advances paper or other print substrate 22 past carriage 12 and ink pens 16. Pens 16 are connected to printing fluid supplies 24. Although remote supplies 24 are shown, the printing fluids could be located on carriage 12 or contained within each pen 16. A controller 26 is operatively connected to carriage 12, printheads 18 and substrate transport 20. Controller 26 represents generally the programming, processor(s) and associated memory(ies), and the electronic circuitry and components needed to control the operative elements of a printer 10. Controller 26 controls the movement of carriage 12 and substrate transport 20. Controller 28 is electrically connected to each printhead 18 to selectively energize fluid dispensing elements for dispensing ink or other printing fluid in the desired pattern on to substrate 22.

Referring now to FIGS. 2-6, carriage 12 includes receptacles 28 to hold removable ink pens 16. For a scanning carriage 12, ink or other printing fluids are supplied to pens 16, for example, through flexible tubing 30 shown in FIG. 2. Printing fluid may be supplied to pens 16 through tubing 30 from a separate supply station while still allowing carriage 12 to scan back and forth across the print substrate. (According to the coordinate system shown in FIGS. 2-4, carriage 12 scans across the print substrate in the X direction, the print substrate moves in the Y direction, and pens 16 dispense fluid in the Z direction.)

Fluid dispensing orifices 32 on each ink pen 16 are exposed through openings 33 along the bottom surface 34 of carriage 12. In the example shown, orifices 32 are part of a printhead 18 located in a snout 36 of each pen 16 that protrudes through openings 33 in carriage bottom surface 34. Shield 14 includes a cover part 35 with openings 37 corresponding to carriage openings 33 so that cover part 35 covers carriage bottom surface 34 in the areas surrounding pen snouts 36. Although other configurations are possible, it is expected that shield cover part 35 usually will conform to the bottom surface 34 of carriage 12 which, in this example, is flat. Also, in this example, shield 14 includes collars 38 surrounding openings 37 and covering the sides of each pen snout 36. As noted above, one adverse side-effect of the new cross-wiping technique is the accumulation of ink residue on the exposed sides of snout 36. Collars 38 on shield 14 collect ink residue that would otherwise accumulate on the exposed sides of snout 36.

During servicing, ink residue is wiped from the exposed parts of each printhead 18 at orifices 32. Ink residue can spatter onto shield 14 during wiping. As noted above, if a sufficient quantity of ink residue collects on shield 14, some of the residue can be dislodged when a pen 16 is replaced, or even during printing, and fall on to the print substrate support platen or on to the print substrate. To help resolve this problem, shield 14 is attached to carriage 12 with a releasable fastener 40 so that the dirty shield can be easily removed from carriage 12 and replaced with a new or recycled (clean) shield before a potentially damaging quantity of ink residue accumulates on the shield.

In the example shown in FIGS. 2-6, releasable fastener 40 is configured as a pair of magnets 42 on shield 14 and corresponding ferrites or other magnetic features 44 on carriage 12. Magnets 42 may be positioned in pockets 46 in shield 14 so they are not exposed to ink residue that collects on shield 14. The magnets 42 could be located on carriage 12 and the ferrites 44 located on shield 14. Shield 14 may be aligned to carriage 12, for example, with guide pins 48 protruding from carriage 12 and alignment holes 50 in shield 14 to receive guide pins 48. In the example shown, one of two alignment holes 50 is significantly larger than the corresponding guide pin 48 to accommodate a misalignment tolerance between the parts.

A magnetic or other such easy-release fastener 40 may be desirable in implementations in which shield 14 will be routinely replaced by the user rather than a service technician. However, other suitable releasable fasteners are possible. For examples screws may be desirable in implementations in which shield 14 will last until a routine printer service appointment when a service technician can replace shield 14.

A replaceable shield 14 need not be resistant to the corrosive effects of the ink residue that collects on shield 14, at least not to the same degree as that needed for a permanent shield used in conventional printers. Thus, depending on the desired longevity of the shield and the operating environment (e.g. type of ink and temperatures) an inexpensive molded plastic shield 14 may be used. Suitable materials for a replaceable shield 14 include, for example, less expensive acrylonitrile butadiene styrene (ABS) where lower corrosion resistance is acceptable to more expensive polyphenylene oxide (PPO) where higher corrosion resistance is desired.

Figure 7:
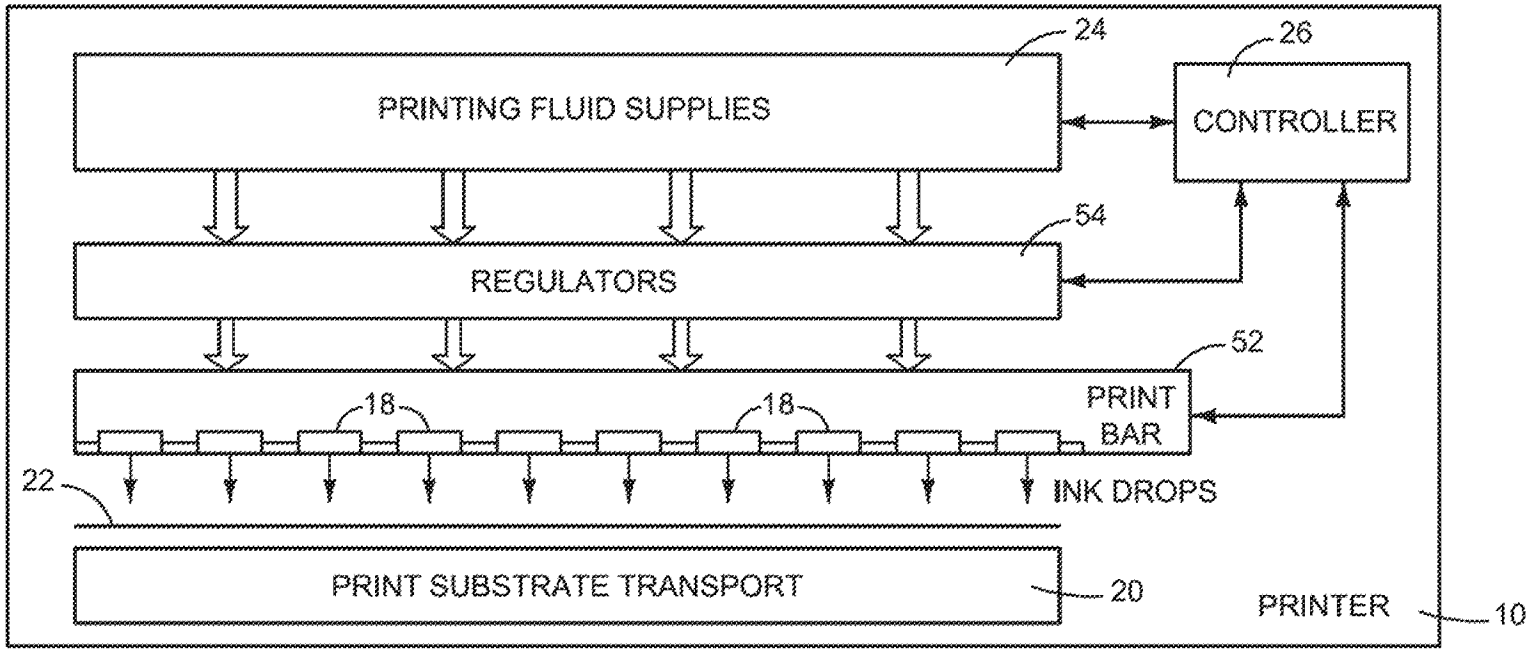
FIG. 7 is a block diagram illustrating an inkjet printer with a print bar implementing another example of a replaceable printing fluid shield.
Figure 8:
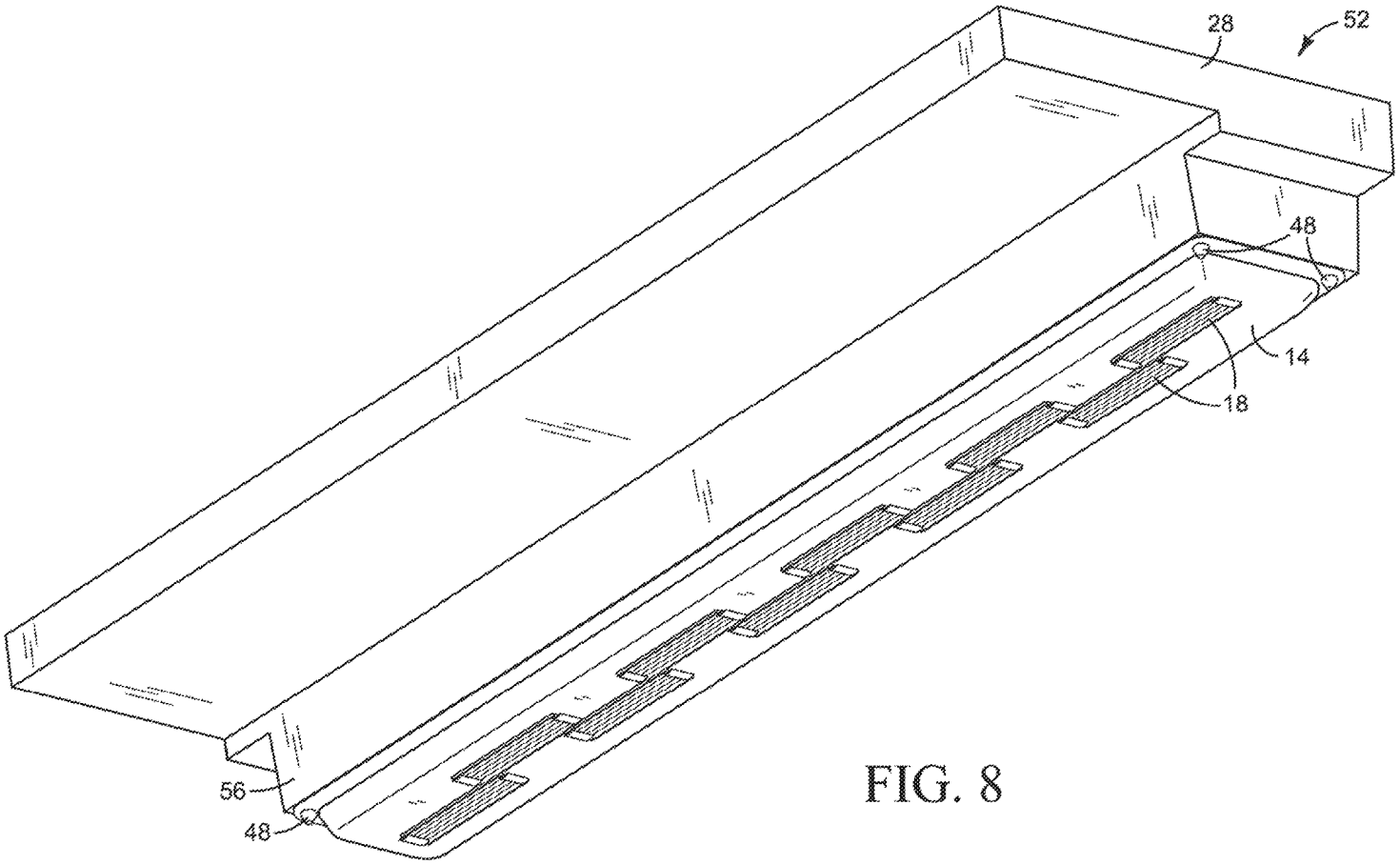
FIG. 8 is perspective view illustrating a print bar implementing one example of a replaceable printing fluid shield such as might be used in the printer shown in FIG. 7.
Figure 9:
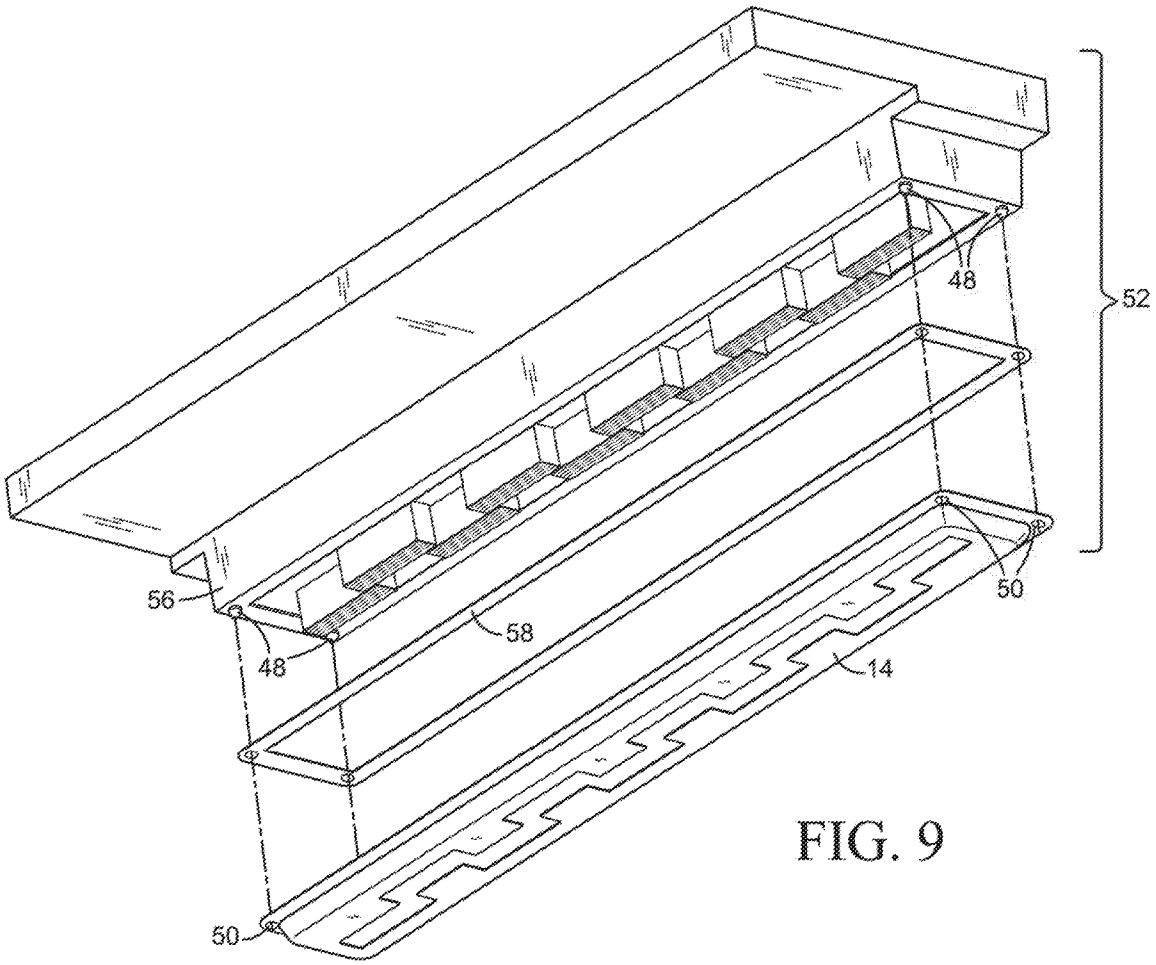
FIG. 9 is the perspective view of FIG. 8 with the printing fluid shield exploded away from the body of the print bar.

FIG. 7 is a block diagram illustrating an inkjet printer 10 with a print bar 52 implementing another example of a replaceable printing fluid shield 14. FIGS. 8 and 9 illustrate a print bar 52 implementing one example of a replaceable shield 14 such as might be used in the printer 10 shown in FIG. 7. Referring first to FIG. 7, printer 10 includes a stationary print bar 52 for dispensing ink or other printing fluid on to substrate 22. Print bar 52 includes multiple printheads 18 spanning the width of substrate 22. For a substrate wide print bar 52, printheads 18 usually will be connected to printing fluid supplies 24 through a set of flow regulators 54 that regulate the flow of ink or other printing fluid to corresponding printheads 18. Referring now also to FIGS. 8 and 9, in this example, shield 14 is attached to the body 56 of print bar 52 with a releasable adhesive 58 that allows shield 14 to be easily removed from print bar 52 and replaced with a new or recycled (clean) shield before excess ink residue accumulates on the shield. Guide pins 48 protruding from print bar body 56 and alignment holes 50 in shield 14 may be used to properly alignment shield 14 to print bar body 56.

"A" and "an" used in the claims means one or more.

As noted at the beginning of this Description, the examples shown in the figures and described above illustrate but do not limit the invention. Other examples are possible. Therefore, the foregoing description should not be construed to limit the scope of the invention, which is defined in the following claims.

What is claimed is:

1. A structure to hold a printhead assembly having a plurality of snouts, each respective snout of the plurality of snouts comprising a printhead orifice in a lower surface of the respective snout, wherein a printing fluid is dispensable through the printhead orifice of the respective snout, the structure comprising:

a surface defining a plurality of openings through which corresponding snouts of the plurality of snouts of the printhead assembly are to protrude for printing; and a replaceable shield shielding an area of the surface around each of the plurality of openings, wherein the replaceable shield comprises a plurality of collars to individually cover side walls of corresponding snouts of the plurality of snouts, each respective collar of the plurality of collars enclosing the side walls of the corresponding snout and extending downwardly from a bottom surface of the replaceable shield, the respective collar extending downwardly by an amount to a point that is at the lower surface of the corresponding snout that protrudes through a respective opening of the plurality of openings, and the respective collar arranged and positioned to collect printing fluid residue resulting from wiping the lower surface that includes the printhead orifice of the corresponding snout.

2. The structure of claim 1, wherein the shield is mounted to the surface with a releasable fastener.

3. The structure of claim 2, wherein the releasable fastener includes a magnet.

4. The structure of claim 2, further comprising:

multiple guide pins protruding from one of the surface and the shield; and multiple alignment holes in the other of the surface and the shield to receive a corresponding one of the guide pins to position the shield over the surface.

5. The structure of claim 1, wherein the shield surrounds each of the plurality of openings.

6. The structure of claim 5, wherein the shield is co-extensive with the surface in an area of the surface surrounding each respective opening of the plurality of openings.

7. The structure of claim 6, wherein the printhead assembly comprises a plurality of removable ink pens, the structure further comprising a plurality of receptacles each configured to hold a respective removable ink pen of the plurality of removable ink pens.

8. A movable carriage including the structure recited in claim 1.

9. A print bar including the structure recited in claim 1.

10. The structure of claim 1, wherein the shield with accumulated printing fluid residue is removable from the surface for replacement with a new replaceable shield.

11. The structure of claim 1, wherein each respective collar of the plurality of collars has walls defining a receptacle to receive the corresponding snout.

12. The structure of claim 1, wherein each respective collar of the plurality of collars is to prevent the printing fluid residue from accumulating on sides of the corresponding snout.

13. A shield for a movable printhead carriage having a plurality of openings therein through which corresponding snouts of a plurality of snouts of a printhead assembly are exposed for printing, each corresponding snout of the plurality of snouts comprising a lower surface having a printhead orifice, the shield comprising:

a cover comprising a plurality of collars to individually cover side walls of corresponding snouts of the plurality of snouts that each protrudes through a respective opening of the plurality of openings in a surface of the carriage when the cover is fastened to the carriage, each respective collar of the plurality of collars enclosing the side walls of the corresponding snout and extending downwardly from a bottom surface of the cover, the respective collar extending downwardly by an amount to a point that is at the lower surface, including the printhead orifice, of the corresponding snout that protrudes through the respective opening; and a fastener to releasably fasten the cover to the carriage.

14. The shield of claim 13, wherein each respective collar of the plurality of collars has walls defining a receptacle to receive the corresponding snout.

15. The shield of claim 13, wherein the fastener includes a magnet.

16. The shield of claim 13, further comprising one of both of:

a guide pin to fit into an alignment hole in the carriage; and an alignment hole to receive a guide pin on the carriage.

17. The shield of claim 13, wherein the shield with accumulated printing fluid residue is removable from the surface for replacement with a new replaceable shield.

18. A method for servicing an inkjet printer that includes a printer surface defining an opening through which a printhead may be exposed for printing, the method comprising:

with a shield, shielding an area of the printer surface surrounding the opening from the accumulation of ink residue; and replacing a dirty shield on which ink residue has accumulated with a clean shield.

19. The method of claim 18, wherein the replacing comprises detaching the dirty shield from the printer surface and attaching the clean shield to the printer surface.

* * * * *